US006708460B1

(12) United States Patent
Elderson

(10) Patent No.: US 6,708,460 B1
(45) Date of Patent: Mar. 23, 2004

(54) STUD WALL SYSTEM AND METHOD USING A COMBINED BRIDGING AND SPACING DEVICE

(75) Inventor: William L. Elderson, North Royalton, OH (US)

(73) Assignee: Dietrich Industries, Inc., Pittsburgh, PA (US)

( * ) Notice: Subject to any disclaimer, the term of this patent is extended or adjusted under 35 U.S.C. 154(b) by 0 days.

(21) Appl. No.: 09/959,036

(22) PCT Filed: Mar. 5, 2000

(86) PCT No.: PCT/US00/11991

§ 371 (c)(1),
(2), (4) Date: Mar. 27, 2002

(87) PCT Pub. No.: WO00/66844

PCT Pub. Date: Nov. 9, 2000

(65) Prior Publication Data

(65)

Related U.S. Application Data

(60) Provisional application No. 60/132,293, filed on May 3, 1999, and provisional application No. 60/140,640, filed on Jun. 23, 1999.

(51) Int. Cl.[7] ..... E04C 2/34

(52) U.S. Cl. ..... 52/481.1; 52/210; 52/668; 52/483.1; 403/375; 403/353; 428/582

(58) Field of Search ..... 52/481.1, 509, 52/241, 210, 668, 667, 669, 483.1, 489.2, 481.2, 720.1, 739.1; 403/375, 353, 384; 428/582, 597, 598, 603

(56) References Cited

U.S. PATENT DOCUMENTS

| | | | |
|---|---|---|---|
| 894,711 | A | 7/1908 | Worcester |
| 992,941 | A | 5/1911 | Danielson |
| 1,101,745 | A | 6/1914 | Jones |
| 1,346,426 | A | 7/1920 | Scherbner |
| 1,603,678 | A | 10/1926 | Furey |
| 1,656,741 | A | 1/1928 | Lane |
| 1,791,197 | A | 2/1931 | Dickson |
| 2,245,908 | A | 7/1941 | Drake |
| 2,430,654 | A | 11/1947 | Voege |
| 2,918,995 | A | 12/1959 | Kruger |
| 3,010,162 | A | 11/1961 | Klein |
| 3,201,874 | A | 8/1965 | Christy |
| 3,305,981 | A | 2/1967 | Biggs et al. |
| 3,322,447 | A | 5/1967 | Biggs |
| 3,374,591 | A | 3/1968 | Tillisch et al. |

(List continued on next page.)

FOREIGN PATENT DOCUMENTS

| | | |
|---|---|---|
| AU | 30388 | 10/1972 |
| GB | 593443 | 10/1947 |
| GB | 2103264 A | 2/1983 |
| WO | WO 93/24712 | 12/1993 |
| WO | WO 96/23945 | 10/1996 |

OTHER PUBLICATIONS

Products That Meet the New A.D.A. Code Flush Mount and Notch Tite and Other Products: Fire Blocking, Bridging, SLP–TRK and Specialty Items, Metal Lite, Inc. Anaheim, CA 1991.

(List continued on next page.)

*Primary Examiner*—Lanna Mai
*Assistant Examiner*—Dennis L. Dorsey
(74) *Attorney, Agent, or Firm*—Kirkpatrick & Lockhart LLP

(57) ABSTRACT

A stud bridging/spacing member (30) generally having at least three longitudinally spaced apart notches (26) for receiving and engaging therein a web of a metal stud. The notches (26) extend at an incline to the longitudinal axis of the elongated member.

37 Claims, 3 Drawing Sheets

U.S. PATENT DOCUMENTS

| | | | |
|---|---|---|---|
| 3,482,369 | A | 12/1969 | Burke |
| 3,562,970 | A | 2/1971 | Schwartz |
| 3,653,172 | A | 4/1972 | Schwartz |
| 4,018,020 | A | 4/1977 | Sauer et al. |
| 4,031,594 | A | 6/1977 | Cepuritis |
| 4,036,307 | A | 7/1977 | Marais |
| 4,043,689 | A | 8/1977 | Spencer et al. |
| 4,075,810 | A | 2/1978 | Zakrzewski et al. |
| 4,208,851 | A | 6/1980 | Sauer |
| 4,225,265 | A | 9/1980 | Hooker et al. |
| 4,235,054 | A | 11/1980 | Cable et al. |
| 4,246,736 | A | 1/1981 | Kovar et al. |
| 4,426,822 | A | 1/1984 | Gailey |
| 4,448,004 | A | 5/1984 | Thorsell |
| 4,522,009 | A | 6/1985 | Fingerson |
| 4,604,845 | A | 8/1986 | Brinker |
| 4,693,047 | A | 9/1987 | Menchetti |
| 4,727,704 | A | 3/1988 | Carlton |
| 4,791,766 | A | 12/1988 | Egri, II |
| 4,809,476 | A | 3/1989 | Satchell |
| 4,840,005 | A | 6/1989 | Cochrane |
| 4,850,169 | A | 7/1989 | Burkstrand et al. |
| 4,858,407 | A | 8/1989 | Smolik |
| 4,860,791 | A | 8/1989 | Putnam |
| 4,914,878 | A | 4/1990 | Tamaki et al. |
| 5,127,760 | A | 7/1992 | Brady |
| 5,155,962 | A | 10/1992 | Burkstrand et al. |
| 5,197,247 | A | 3/1993 | Elderson |
| 5,274,973 | A | 1/1994 | Liang |
| 5,287,664 | A | 2/1994 | Schiller et al. |
| 5,488,198 | A | 1/1996 | Kramer |
| 5,720,138 | A | 2/1998 | Johnson |
| 5,784,850 | A | 7/1998 | Elderson |
| 5,822,942 | A | 10/1998 | Lucia, Jr. |
| 5,870,874 | A | 2/1999 | Brothers |
| 5,904,023 | A | 5/1999 | DiGirolamo et al. |
| 5,964,071 | A | 10/1999 | Sato |
| 6,021,618 | A | 2/2000 | Elderson |
| 6,241,199 | B1 | 6/2001 | Ismert |
| 6,301,854 | B1 | 10/2001 | Daudet et al. |
| 2002/0059773 | A1 | 5/2002 | Elderson |
| 2003/0037494 | A1 | 2/2003 | Collins et al. |
| 2003/0089053 | A1 | 5/2003 | Elderson |

OTHER PUBLICATIONS

Brochure—Trus Wall Systems, Don't Just Space It, Brace It, Arlington, Texas, Publication date unknown.

U.S. application Ser. No. 10/383,047, Brunt, unpublished.

U.S. application Ser. No. 10/641,062, Elderson, unpublished.

Plaintiff, Dietrich Industries Inc.'s Claim Construction Submission, Dietrich Industries, Inc. v. The Steel Network, Inc., (WD. PA.), Civil Action No. 02–0354.

Appendix to Plaintiff, Dietrich Industries, Inc.'s Claim Construction Submission, Dietrich Industries, Inc. v. The Steel Network, Inc., (WD. PA.), Civil Action No. 02–0354.

Plaintiff, Dietrich Industries, Inc.'s, Response to Defendant's Claim Construction Submission, Dietrich Industries, Inc. v. The Steel Network, Inc., (WD. PA.), Civil Action No. 02–0354.

Plaintiff, Dietrich Industries, Inc.'s, Reply to Defendant's Dec. 5, 2002 Claim Construction Submission, Dietrich Industries, Inc. v. The Steel Network, Inc., (WD. PA.), Civil Action No. 02–0354.

Defendant, The Steel Network, Inc.'s, Memorandum Re Claim Construction, Dietrich Industries, Inc. v. The Steel Network, Inc., (WD. PA.), Civil Action No. 02–0354.

Defendant, The Steel Network, Inc.'s, Appendix of Exhibits in Support of Defendant's Memorandum Re Claim Construction, Dietrich Industries, Inc. v. The Steel Network, Inc., (WD. PA.), Civil Action No. 02–0354.

Defendant, The Steel Network, Inc.'s Reply Brief Regarding Claim Construction, Dietrich Industries, Inc. v. The Steel Network, Inc., (WD. PA.), Civil Action No. 02–0354.

Defendant, The Steel Network, Inc.'s, Claim Constriction Reply Brief, Dietrich Industries, Inc. v. The Steel Network, Inc., (WD. PA.), Civil Action No. 02–0354.

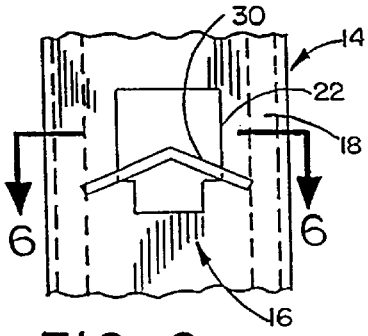
FIG. 2
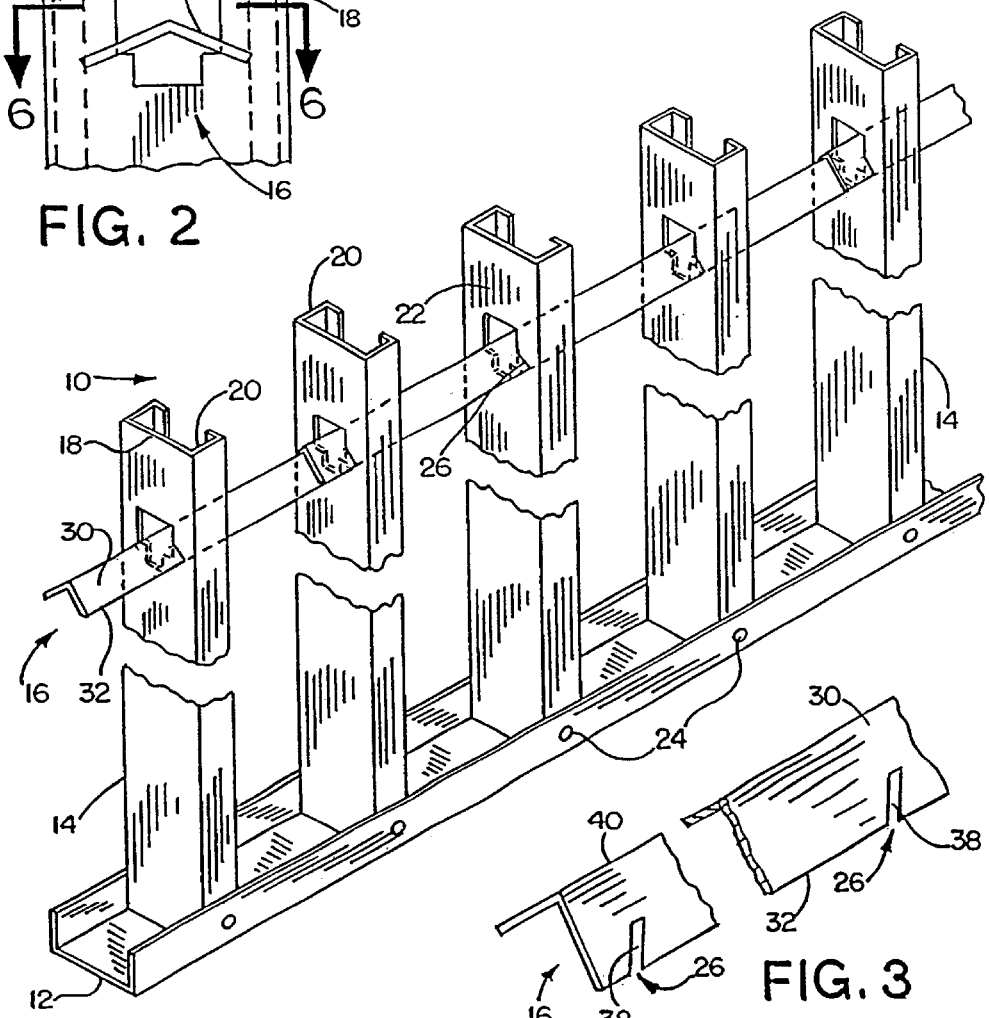
FIG. 1
FIG. 3
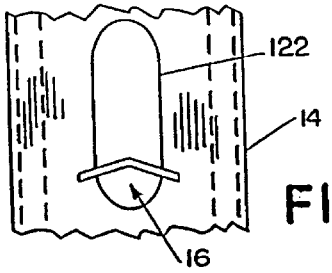
FIG. 4

STUD WALL SYSTEM AND METHOD USING A COMBINED BRIDGING AND SPACING DEVICE

This application is a 371 of PCT/US00/11991 filed Mar. 5, 2000 and claims benefit to Provisional Nos. 60/132,293 filed May 3, 1999 and No. 60/140,640 filed Jun. 23, 1999.

FIELD OF THE INVENTION

The invention herein described relates generally to stud wall systems and more particularly to a device for spacing and bridging studs in a stud wall.

BACKGROUND OF THE INVENTION

Metal studs are used to form walls in building structures today, including load bearing walls such as exterior walls and curtain walls. In a typical installation, the metal studs are secured by screws at their lower ends to a bottom track secured to a floor, and extend at their upper ends into a top track secured to overhead joists which may form the framework for an upper floor. The upper ends of the studs generally also are secured to the top track. Exterior wall materials and/or wall boards or other panels are applied to the sides of the studs to form a closed wall structure.

The load bearing walls are subject to axial loads (compressive loads on the studs) applied to the studs through the overhead joists, and also may be subject to transverse loads (for example, exterior walls may be subject to transverse loads from wind effects) and lateral loads acting in the plane of the wall. These loads may cause flexing (including bowing, twisting or other deformation of the stud) or turning of the metal studs which may cause the walls to crack or otherwise be flawed or damaged. In load bearing walls, this problem is structural as well as aesthetic.

Bridging systems heretofore have been used to reinforce the metal stud walls by adding structural support between adjacent studs. Three known bridging systems include braced channel, welded channel, and block-and-strap bridging systems.

In the braced channel bridging system, a U-shape channel spans two or more metal studs, extending through a conduit hole in the web of each stud. An angled brace is fastened to both the channel and the web of the stud, generally with screws or rivets.

The welded channel bridging system also uses a U-shape channel which spans two or more metal studs and extends through conduit holes in the webs of the studs. The channel is then welded to the studs on one or both sides of the channel.

In the block-and-strap bridging system, sheet metal "blocks" are fastened between adjacent studs through bent tabs at their distal ends. Then a strap is fastened to one or both sides of two or more metal studs as well as to the respective side or sides of the blocks. Thus the studs are interconnected by the blocks between the studs as well as the straps along the sides of the studs, and the blocks and straps also are connected to each other.

The installation of metal stud wall systems, including the reinforcing bridging systems, heretofore has been a time consuming process. In a typical installation where the metal studs are fastened at their upper ends to a top track or channel, the attachment positions of the studs are marked off along the top track. Then each stud is fastened to each flange of the top track by screws. A ladder or a scaffold may be required if the top track is too high for the installer to reach.

If a ladder is used, the installer climbs the ladder and fastens as many studs as he can reach to the near flange of the top track. Then he must climb down the ladder, move the ladder along the wall so that when he again climbs the ladder he can reach the next one or more studs for fastening to the top track. If a scaffold is used, much more time is expended setting up the scaffold. After doing this along one side of the wall, the process is repeated on the other side of the wall to fasten the studs to the other flange of the top track.

The metal studs must then be fastened at their lower ends to a bottom track or channel. Each stud must be carefully aligned and squared before being fastened to the bottom track. In addition, the bridging members described above also must be installed to interconnect the metal studs at one or more points between the top and bottom tracks. Because of the time consuming nature of the installation process, fasteners can be missed or forgotten. In the welded channel bridging systems, welders and their equipment are relatively expensive, and welds also can be missed, or can be improperly formed. Defects in welds can be particularly difficult to detect.

In addition, once the studs are installed, other trades people, such as plumbers and electricians, may remove the bridging members between two studs to give them more room to work, running plumbing lines or electrical lines, for example. If the bridging member is not replaced, the strength of the wall may be reduced.

SUMMARY OF THE INVENTION

The present invention provides a stud bridging/spacing member for the quick and easy spacing of a plurality of studs without measuring, while at the same time providing bridging between the studs. The bridging function of the stud bridging/spacing member reinforces the studs to resist bending under axial loads and to resist rotation under transverse loads, providing a "shear" connection between the bridging/spacing member and the studs. The stud bridging/spacing member enables a substantial reduction in the amount of time needed to install a metal stud wall and, in particular, a load bearing wall, while at the same time functioning effectively to lock each stud against bowing, twisting or turning when subject to axial, transverse and/or lateral loads, thereby providing improved strength and rigidity to the metal stud wall. The invention also provides a metal stud wall including the stud bridging/spacing member and a method of assembling a metal stud wall using the stud bridging/spacing member. The angled slots, or more accurately the angled sides thereof, coact with the webs of the studs to inhibit twisting, turning or bowing of the studs when subjected to axial and/or lateral and/or transverse loads. Moreover, as the loads increase, the angled slots more tightly lock with the stud webs by providing the "shear" connecting between the bridging/spacing member and the webs of the studs.

According to one aspect of the invention, a stud bridging/spacing member includes an elongate member having at least three longitudinally spaced apart notches for receiving and engaging therein a web of a metal stud. The notches extend at an incline to the longitudinal axis of the elongate member to accommodate different gauges of metal studs while maintaining on-center spacing of studs when assembled in a stud wall.

According to one embodiment of the invention, the notches extend inwardly at an angle of about two to about fifteen degrees relative to a perpendicular to the longitudinal axis, and more preferably about five and a half degrees to about eight degrees, and most preferably about seven degrees. The notches have a width of about 0.050 inch (about 0.13 cm) to about 0.1 inch (about 0.2 cm), more preferably about 0.065 inch (about 0.16 cm) to about 0.080 inch (about 0.20 cm), and most preferably about 0.080 inch (about 0.20 cm). The elongate member is formed of fourteen, sixteen or eighteen gauge metal (more preferably steel and most preferably galvanized steel).

The at least three notches generally extend laterally inwardly from laterally outer edges of the elongate member. The elongate member may include a fourth notch equally spaced between at least two of the at least three notches. Each of the at least three notches in one portion of the elongate member may be laterally aligned with a corresponding notch in another portion of the elongate member, and/or the laterally aligned notches may incline in the same direction. The sides of the notches generally are parallel, and straight.

Further in accordance with an embodiment of the present invention, the elongate member has a V-shape lateral cross-section formed by longitudinally extending planar first and second portions joined at respective longitudinal edges to form the sides and vertex of the V-shape. The elongate member further may include a pair of wing portions extending laterally outwardly from respective distal ends of the V-shape elongate member. The wing portions may extend in opposite directions from the V-shape elongate member, and each wing portion may extend a distance which is approximately one-third the width of the widest part of the V-shape elongate member. The angle of the V is at least about 90°, more preferably at least about 120° and most preferably about 130°. A shallow angle increases the transverse stiffness of the elongate member, although other means may be used for this purpose.

According to another aspect of the present invention, a metal stud wall includes at least three metal studs each having at least two flanges interconnected by a web. The web of each stud has an opening, and the studs are arranged in a row with the openings in the webs thereof aligned with one another. An elongate member as described above extends through the openings of the at least three studs, and the at least three longitudinally spaced apart notches engage the webs of the studs. The notches generally are equally longitudinally spaced apart at a predetermined web to web spacing of the studs. The web to web spacing may be sixteen inches (about 40.6 cm) or twenty-four inches (about 61.0 cm). The metal stud wall typically will include one or more additional elongate members with adjacent ends overlapping and engaged with respect to a common stud.

In assembling a metal stud wall including a row of metal studs each having at least two flanges interconnected by a web, each stud is fastened at a lower end to a base track. A stud bridging/spacing member is inserted through aligned openings in at least three metal studs, and longitudinally spaced apart notches in the stud bridging/spacing member are engaged with respective webs of the metal studs, thereby establishing and maintaining a fixed spacing between the metal studs and reinforcing the studs against deflection and turning under loading. When the notches engage the webs of the studs, a portion of the webs of the studs generally is caused to bend (at least under load conditions) in the direction of the inclines of the notches to retain the web in the engaged notch. The assembly method may also include securing a top end of each of the studs to a ceiling track.

The foregoing and other features of the invention are hereinafter fully described and particularly pointed out in the claims, the following description and the annexed drawings setting forth in detail certain illustrative embodiments of the invention, these being indicative, however of but a few of the various ways in which the principles of the invention may be employed.

BRIEF DESCRIPTION OF THE DRAWINGS

FIG. 1 is a perspective view of a metal stud wall including a stud bridging/spacing member according to the present invention.

FIG. 2 is an elevational end view of a stud showing the stud bridging/spacing member disposed in an opening in a metal stud of the wall.

FIG. 3 is a perspective view of the stud bridging/spacing member, showing the notch in the bridging/spacing member.

FIG. 4 is an elevational end view of a stud showing the stud bridging/spacing member disposed in another type of opening in a metal stud.

DETAILED DESCRIPTION

Figure 5:
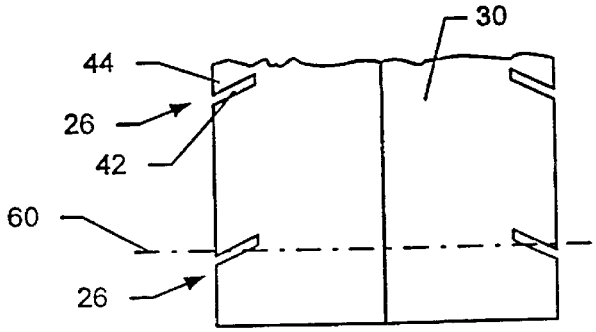
FIG. 5 is a top view of the stud bridging/spacing member.

FIG. 1 illustrates the skeleton of a metal stud wall 10 according to the present invention. The metal stud wall 10 generally comprises a base track 12, a plurality of metal studs 14 disposed in a row, at least one bridging/spacing member 16, and wall panels (not shown). The wall panels, such as wall board, may be secured in a well known manner to one or both sides of the metal studs to close the wall and to form the exterior surface or surfaces of the wall. Alternatively, one or both sides of the metal studs may be faced with masonry, such as a brick wall facing on an exterior side of a curtain wall.

The studs 14, as illustrated in FIG. 1, are generally C-shape, as is conventional. The studs 14 have a web 18 and a pair of L-shape flanges 20 perpendicular to the web 18. There is also one or more openings 22 in the web 18. The openings 22 heretofore have been provided in metal studs to permit bridging members, electrical conduit and/or plumbing to be run within the stud wall. Since the openings 22 are located in the same position in the individual studs forming the wall as is conventional, the openings 22 are horizontally aligned with each other as shown in FIG. 1. Note that the particular opening 22 shown in FIGS. 1 and 2 are generally found in nonload-bearing walls.

Although in the illustrated stud wall 10 the stud bridging/spacing member 16 engages the webs 18 of the studs 14 adjacent the base of the upper rectangular portion of the opening 22, alternatively the stud bridging/spacing member 16 may be dimensioned to engage the webs of the studs adjacent the base of the lower rectangular portion of the opening 22. The larger stud bridging/spacing member may provide more resistance to loading on the studs, however, it also may restrict the ability to run electrical conduit and/or plumbing through the opening 22. Thus, since this type of opening 22 is generally used in nonload-bearing stud walls which are subject to smaller loads, the smaller stud/bridging member may be used. However, the stud bridging/spacing member 16 may be used in load bearing stud walls, wherein the studs generally have a different type of opening, as hereinbelow is further explained.

In the assembly of the metal stud wall 10, the metal studs 14 are secured at their lower ends to the base track 12 by fastening means 24, such as screws, rivets, etc. The base track 12 is a U-shape channel having a central planar strip with upstanding legs at lateral sides thereof. The studs forming the wall are secured by the fastening means 24 to the upstanding legs of the base track 12 that normally will be anchored to the floor. The metal studs extend into a ceiling track (not shown) which is similar to the base track 12, except that it is secured to (or has secured thereto) overhead joists which may form the framework for an upper floor.

The stud bridging/spacing member 16 is inserted through the openings 22, and a plurality of notches 26 in the stud bridging/spacing member 16 are aligned with the webs 18 of respective studs 14, or vice versa, the notches 26 being designed to engage and to retain the webs 18 of the studs 14 therein. The stud bridging/spacing member 16 is turned and is moved downwardly, as by tapping, to move the webs 18 of the metal studs 14 into engagement with the notches 26. In this manner the stud bridging/spacing member 16 sets the spacing of the studs 14, thus making it unnecessary to manually mark off the stud spacing. As a result, only one stud need be plumbed and secured to surrounding structure, such as at its top to the ceiling track (not shown). With one stud plumbed and fixed in place, all of the other studs will be spaced and held plumb by the bridging/spacing member or chain of overlapping bridging/spacing members without measuring. In an exterior load bearing wall, generally each of the studs also is secured at its upper end to the ceiling track.

The stud bridging/spacing member 16 also functions to rigidly maintain the metal studs 14 at the prescribed spacing, for example, during application of the wall panels (not shown) to the studs. Although the wall panels once applied also will help maintain the spacing of the metal studs, the stud bridging/spacing member 16 resists relative movement of the metal studs in the plane of the wall and resists flexing of the studs. In fact, additional bridging/spacing members 16 may be provided at different heights to further strengthen the metal stud wall 10. Openings 22 in the webs of the studs are usually vertically spaced apart approximately four feet on center in load bearing studs, and thus different sets of bridging/spacing members 16 are similarly vertically spaced.

As illustrated in FIG. 1, each stud bridging/spacing member 16 spans at least three metal studs 14, although longer bridging/spacing members may be used, if desired, to span four, five or more studs, or even shorter bridging/spacing members spanning only two studs. When forming a wall system having a number of metal studs spaced apart to exceed the length of a single stud bridging/spacing member 16, a plurality of stud bridging/spacing members 16 are used in an end-to-end relationship with relatively adjacent ends overlapped and secured to at least one common stud 14 so as to maintain the continuity of the stud bridging/spacing members 16 over the length of the stud wall 10.

Referring now to FIGS. 2–5, one embodiment of stud bridging/spacing member 16 can be seen to include a bar-like elongate member 30 which is generally V-shape in cross-section along its length. The V-shape functions to rigidity the elongate member 30 against lateral flexure, i.e., flexure perpendicular to the longitudinal axis of the bridging/spacing member.

The overall length of the stud bridging/spacing member 16 is about fifty inches (127 cm). The bridging/spacing member 16 is sufficiently narrow in at least one dimension to fit within the dimensions of the openings 22 in the webs 18. The type of conduit opening 22 shown in FIG. 2 is typically about one inch (about 2.5 cm) wide in its lower region. The width of the bridging/spacing member 16 is approximately two and one quarter inches (about 5.7 cm) when oriented as shown in FIG. 2 (i.e., from outer edge to outer edge), and the vertex of the V is about half an inch (about 1.3 cm) from a plane which contains the distal ends of the legs of the V. Accordingly, the bridging/spacing member 16 generally has an included angle greater than 90° and less than 180°, and more preferably has an included angle of about 132°. It has been found that generally a shallower angle (wider space between the distal ends of the legs) provides more resistance to deflection under lateral loads, whereas a deeper angle (narrower space between the distal ends of the legs) may provide more resistance to deflection under compression loads (axial loads on the studs 14, see FIG. 1). However, since the bridging/spacing member 16 is more likely to be subject to lateral loads since the studs 14 (FIG. 1) support the vertical loads axially, a shallower included angle may be used.

The metal which forms the stud bridging/spacing member 16 has a thickness ranging, for example, from about twenty gauge (about 0.034 inch (about 0.086 cm)) to about fourteen gauge (about 0.071 inch (about 0.18 cm)). The stud bridging/spacing member 16 is constructed from about sixteen gauge metal, which has a thickness of about 0.058 inch (about 0.15 cm). Eighteen gauge metal has a thickness of about 0.045 inch (about 0.11 cm).

The elongate member 30 need not necessarily have a V-shape as shown in FIG. 3. The elongate member 30 alternatively could be generally planar with one or more bosses running (and overlapping if plural bosses are provided) the length of the elongate member 30. The boss or bosses (deflected out of the planar portions of the elongate member) would serve to rigidity the elongate member 30. Of course, other means may be provided to rigidity the elongate member 30 against lateral flexure, such as the use of stiffening ribs, a thicker stock, etc. In addition, the stud bridging/spacing member 16 may be used with studs 14 having openings 122 as shown in FIG. 4.

Referring to FIG. 3, each planar side portion of the V-shape elongate member 30 is provided with the plurality of notches 26 which open to the longitudinal or laterally outer edge 32 of the respective side portion. The notches 26 are formed to a depth from the edge of about three-eighths of an inch (about 0.95 cm). Although the notches 26 are shown disposed along the outer edge 32 of each side portion, the notches 26 could be formed elsewhere, although less desirably, such as along the vertex (crease) 40 of the V-shape elongate member 30.

The notches 26 of one side portion are laterally aligned with corresponding notches of the other side portion. The pairs of laterally aligned notches 26, as opposed to a single notch, provide two areas of contact with the web 18 of a stud 14 (see FIGS. 1 and 2). The two areas of contact enhance the grip of the bridging/spacing member 16 on the webs 18 of the studs 14 and aid in preventing the studs 14 from pivoting or twisting, thus adding greater stability to the wall 10 (see FIG. 1).

Referring now to FIGS. 3 and 5, each notch 26 is formed by a slot 38 inclined relative to the longitudinal axis of the stud bridging/spacing member 16, wherein the angle and the width of the slot 38 cooperate to bind the webs 18 of the studs 14 in the notches 26 (see FIG. 1). The slot 38 has a width of about 0.065 inch (about 0.16 cm) to about 0.080 inch (about 0.20 cm), and is angled about five and a half degrees to about eight degrees relative to a perpendicular 60 to the longitudinal axis of the bridging/spacing member 16. More preferably, the slot 38 is angled about seven degrees and has a width of about 0.080 inch (about 0.20 cm). The slot 38 generally has parallel sides that are straight. However, other configurations are contemplated. For example, the slot 38 may have curved parallel sides.

The stud bridging/spacing member 16 is made of eighteen to fourteen gauge metal. The width and angle provide notches 26 which have been found to fit twenty gauge studs 14 (FIG. 1), to fit eighteen gauge studs 14 with a slight bind, and to fit sixteen gauge studs 14 tightly, which may cause the webs 18 (FIG. 1) of the studs 14 to bend slightly with the notch 26. The notches 26 have also been found to fit fourteen gauge studs 14, with a tight fit. The tighter fit with heavier gauge studs is desired as usually they are used to bear higher loads.

Figure 6:
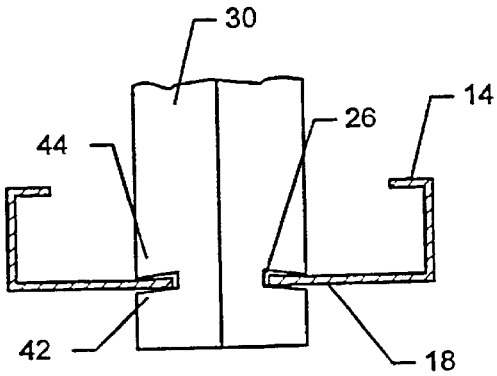
FIG. 6 is a top view of the stud and the stud bridging/spacing member as seen along 6—6 of FIG. 2.

As shown in FIGS. 5 and 6, the sides of the angled notch 26 form angled shoulders in adjacent portions of the elongate member 30, one of which forms an abutment 42 against which the web 18 of the stud 14 is urged, and the other of which forms a barb 44 which can bite into the web 18 of the stud 14 and about which the web 18 of the stud 14 may deform as the web 18 is inserted into the notch 26. The angle and the width of the slot 38 cooperate to bind the web 18 of the stud 14 in the slot, at least when subjected to loads that would tend to cause the elongate member to become dislodged. The bind forces a portion of the web 18 to bend with the angle of the slot 38. However, generally neither the barb 44 nor the abutment 42 move out of the plane of the planar portion of the elongate member 30.

Installation of the bridging/spacing member 16 causes the webs 18 of the studs 14 to be urged against the abutments 42 to place the studs "on center" against the opposing wall of the slot, i.e., the barb 44 urges the web 18 against the abutment 42. The distance between the cuts that form the abutments 42 can be controlled within tight tolerances and this translates to accurate spacing of the studs in a row thereof forming a wall.

For example, in the United States, stud walls are generally constructed with studs spaced on sixteen or twenty-four inch (about 40.6 cm to 61.0 cm) centers. Therefore, a cut in the elongate member 30 will be made at sixteen or twenty-four inch (about 40.6 cm to 61.0 cm) intervals, thus ensuring that the web to web spacing of the studs 14 will be sixteen or twenty-four inches (about 40.6 cm to 61.0 cm).

Figure 7:
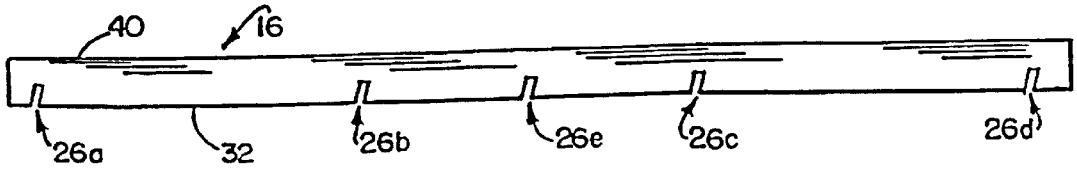
FIG. 7 is a side view of the stud bridging/spacing member showing one spacing of the notches.

As illustrated in FIG. 7, the stud bridging/spacing member 16 includes four notches 26*a*–26*d* spaced at sixteen (about 40.6 cm) intervals, and one notch 26*e* equally spaced between the two central notches 26*b* and 26*c*. This particular arrangement of notches 26 creates a stud bridging/spacing member 16 which can be used in metal stud walls 10 (FIG. 1) which have a stud spacing of either sixteen or twenty-four inches (about 40.6 cm to 61.0 cm). If the wall 10 is to have a stud spacing of sixteen inches (about 40.6 cm), notches 26*a*–26*d* engage the webs 18 of the studs 14 (see FIG. 1). If the wall 10 is to have a stud spacing of twenty-four inches (about 61.0 cm), notches 26*a*, 26*d*, and 26*e* engage the webs 18 of the studs 14. Since the overall length of the stud bridging/spacing member 16 is about fifty inches (about 127 cm), this leaves about one inch (about 2.5 cm) outside the outermost notches.

An embodiment of the bridging/spacing member 16 having the slanted notch 26 described above has been found to provide improved strength to the metal stud wall 10 (FIG. 1) under loads far in excess of those required by most building codes for load bearing walls. The present invention provides a bridging/spacing member that rigidly connects the studs in a stud wall, unlike some prior spacing members which allow the framing system to flex in length to accommodate the attachment of wall panels wrapped in a heavy wall covering. In addition, unlike prior bridging systems, installation of the stud bridging/spacing member having the slanted notches does not require fasteners and yet resists deformation and turning of the studs under load. For example, under extreme lateral loading conditions, the bridging/spacing member of the present invention has been found to fail only by shearing through the webs of the studs at forces far higher than those at which other bridging systems failed by breaking their fasteners. Accordingly, the bridging/spacing member 16 can be quickly and easily installed, simultaneously spacing and reinforcing the metal studs in a stud wall.

Figure 9:
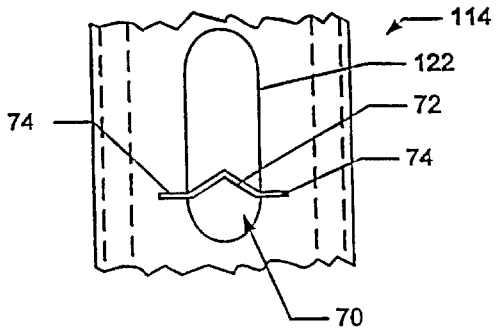
FIG. 9 is an elevational view of a stud showing the stud bridging/spacing member of FIG. 8 disposed in an opening in a metal stud of the wall.
Figure 8:
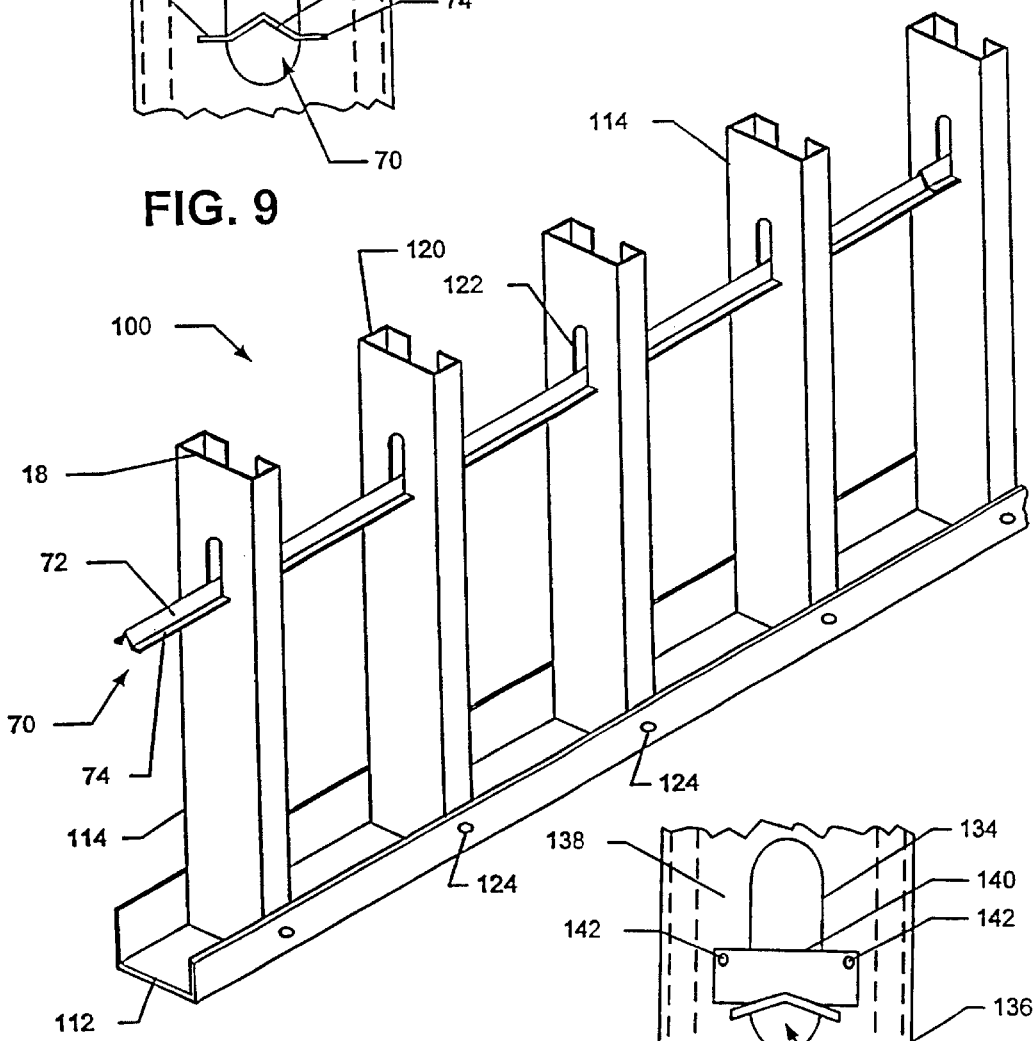
FIG. 8 is a perspective view of a metal stud wall including another stud bridging/spacing member according to the present invention.

An alternative stud bridging/spacing member 70 is shown in FIGS. 8 and 9. In this embodiment, the stud bridging/spacing member 70 has a central portion 72 similar to the V-shape of the stud bridging/spacing member 16 described above (see FIG. 2), with a pair of laterally extending wing portions 74 extending outwardly from distal ends of the V-shape central portion 72. The wing portions 74 extend a distance equal to about one-third of the width of the central portion 72. The wing portions 74 extend in opposite directions in a common plane, however, the wing portions 74 may extend in different planes. The stud bridging/spacing member 70 has at least three longitudinally spaced pairs of transversely aligned notches 76 of the type described above. The notches may extend only through the wing portions 74 or may also extend into the V-shape central portion 72.

The stud bridging/spacing member 70 can be installed in a stud wall 100 in the same way as the stud bridging/spacing member 16 is installed in the stud wall 10 in FIG. 1. The stud wall 100 includes a plurality of studs 114, each stud 114 having a web 118 and a pair of L-shape flanges 120 perpendicular to the web 118, with at least one opening 122 in the web 118. Unlike the opening 22 shown in FIGS. 1 and 2, the opening 122 has a uniform width central portion and rounded end portions. This type of opening 122 is more common in load bearing studs. Another type of opening (not shown) is similar but has pointed ends. The stud bridging/spacing member 70 is not limited to any form of opening, however.

The studs 114 are secured at their lower ends to the base track 112 by fastening means 124 in the same manner as described above with reference to FIG. 1. The stud bridging/spacing member is inserted through the openings 122 and the notches 76 are aligned with the webs 118 of the studs 114. The bridging spacing member 70 may be rotated and is then moved down over the webs 118 of the studs 114 to engage the lower end of the central portion of the opening 122 as shown in FIG. 9. Additional bridging/spacing members 70 overlap adjacent ends of preceding bridging/spacing members 70 as needed to provide continuous bridging between all of the studs 114 in the wall 100. The upper ends of the studs 114 may then be connected to a ceiling track (not shown) as required.

The addition of the wing portions 74 facilitates installation by making it easier to "eyeball" the stud bridging/ spacing member 70 to make sure it is level and thus firmly seated in each opening 122 in the webs 118 of the studs 114. This feature helps to improve the speed and quality of the installation process. In addition, the wing portions 74 further rigidity the stud bridging/spacing member 70 against transverse loads on the wall 100, which may be particularly advantageous, for example, in external walls in building locations subject to high wind loads.

The Applicant has found that the bridging system and method described herein performs approximately as well as or better than several more labor-intensive (and therefore generally more expensive) bridging systems under different types of loads. As a result, the system and method of the present invention provide approximately the same structural strength, while the spacing function of the bridging/spacing member helps to greatly reduce installation time, thereby providing substantial cost savings.

Figure 10:
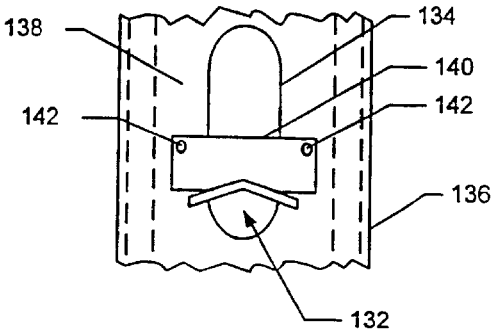
FIG. 10 is an elevational view of a stud showing the bridging/spacing member of FIG. 4 disposed in the opening with a bar guard.

As shown in FIG. 10, the system and method of the present invention may also include a bar guard to minimize or prevent other building tradespeople from removing the bridging/spacing member 132 from the conduit opening 134 in the stud 136. The bar guard may include a screw driven through the web 138 of the stud to prevent the bridging/spacing member from being lifted out, or a metal plate, such as the illustrated plate 140, attached to the web of the stud above the bridging/spacing member. The illustrated bar guard 140 has a notch at a lower end to closely engage the top of the bridging/spacing member and a pair of holes 142 near an upper edge for fastening the bar guard to the web of the stud with screws, although other methods of attaching the bar guard to the stud could be used. Since the bridging/spacing member spans at least three studs, the bar guard does not have to be attached to every stud. Thus installation of the bridging/spacing member with the bar guard does remains much quicker than conventional methods.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention may have been described above with respect to only one of several illustrated embodiments, such feature may be combined with one or more other features of the other embodiments, as may be desired and advantageous for any given or particular application.

What is claimed is:

1. A stud bridging/spacing member comprising:

an elongate member having a V-shaped lateral cross-section formed by longitudinally extending planar first and second portions joined at respective longitudinal edges to form sides and a vertex of the V-shape that defines a longitudinal axis; and at least three longitudinally spaced apart notches in at least one of said longitudinally extending planar first and second portions for receiving and engaging therein a web of a metal stud, each notch extending inwardly at an acute angle relative to an axis that is perpendicular to the longitudinal axis of the elongate member.

2. The stud bridging/spacing member of claim 1, wherein the elongate member includes a fourth notch equally spaced between at least two of the at least three notches.

3. The stud bridging/spacing member of claim 1, wherein each of the at least three notches in one portion of the elongate member are laterally aligned with a corresponding notch in another portion of the elongate member.

4. The stud bridging/spacing member of claim 3 wherein the laterally aligned notches incline in a same direction.

5. The stud bridging/spacing member of claim 1, wherein the notches extend inwardly at an angle of about five and a half degrees to about eight degrees relative to the axis that is perpendicular to the longitudinal axis.

6. The stud bridging/spacing member of claim 1, wherein the notches extend inwardly at an angle of about seven degrees.

7. The stud bridging/spacing member of claim 1, wherein the notches incline in the same direction.

8. The stud bridging/spacing member of claim 1, wherein the notches have a width of about 0.065 inch (about 0.16 cm) to about 0.080 inch (about 0.20 cm).

9. The stud bridging/spacing member of claim 1, wherein the notches have a width of about 0.080 inch (about 0.20 cm).

10. The stud bridging/spacing member of claim 1, wherein each said notch has parallel sides.

11. The stud bridging/spacing member of claim 1, wherein the elongate member is formed in a thickness selected from the group of fourteen, sixteen and eighteen gauge metal.

12. A metal stud wall comprising:

at least three metal studs each having at least two flanges interconnected by a web, the web of each stud having an opening and the studs being arranged in a row with the openings in the webs thereof aligned with one another; and at least one elongate member as set forth in claim 1 extending through the openings of the at least three studs, the at least three longitudinally spaced apart notches engaging the webs of the studs.

13. The metal stud wall of claim 12, wherein the notches are equally longitudinally spaced apart at a predetermined web to web spacing of the studs.

14. The metal stud wall of claim 12, wherein the web to web spacing is sixteen inches (about 40.6 cm).

15. The metal stud wall of claim 12, wherein the web to web spacing is twenty-four inches (about 61.0 cm).

16. The metal stud wall of claim 12, wherein the notches extend inwardly at an angle of about five and a half degrees to about eight degrees relative to an axis that is perpendicular to the longitudinal axis of the elongate member.

17. The metal stud wall of claim 12, wherein the notches extend inwardly at an angle of about seven degrees.

18. The metal stud wall of claim 12, wherein the notches have a width of about 0.065 inch (about 0.16 cm) to about 0.080 inch (about 0.20 cm).

19. The metal stud wall of claim 12, wherein the notches have a width of about 0.080 inch (about 0.20 cm).

20. The metal stud wall of claim 12, wherein the at least one elongate member includes a second elongate member as set forth in claim 1, the second elongate member extending through the opening of one of the studs through which the one elongate member extends and through the openings in the webs of at least two further studs, the notches of the second elongate member engaging respective webs of each of the studs through which it passes.

21. A method of spacing and reinforcing a plurality of spaced apart metal studs in a stud wall, comprising fastening a lower end of each stud to a base track, inserting a stud bridging/spacing member as set forth in claim 1 through aligned openings in at least three metal studs, and engaging longitudinally spaced apart notches in the stud bridging/spacing member with respective webs of the metal studs, thereby establishing and maintaining a fixed spacing between the metal studs and reinforcing the studs against deflection and turning under loading.

22. The method of claim 21, further comprising securing a top end of each of the studs to a ceiling track.

23. The method of claim 21, wherein engaging includes causing a portion of the webs of the studs to bend in the direction of the inclines of the notches to retain the web in the engaged notch.

24. A stud bringing/spacing member comprising:

an elongate member having a first planar portion defining a first plane and a second planar portion defining a second plane that is not co-planar with said first plane, said elongate member having a longitudinal axis; and at least three longitudinally spaced apart notches in at least one of said longitudinally extending planar first and second planar portions, each notch extending inwardly at an acute angle relative to a corresponding axis that is perpendicular to the longitudinal axis of the elongate member.

25. The stud bridging/spacing member of claim 24, wherein the elongate member includes a fourth notch equally spaced between at least two of the at least three notches.

26. The stud bridging/spacing member of claim 24, wherein each of the at least three notches in one portion of the elongate member are laterally aligned with a corresponding notch in another portion of the elongate member.

27. The stud bridging/spacing member of claim 26, wherein the laterally aligned notches incline in the same direction.

28. The stud bridging/spacing member of claim 24, wherein the notches extend inwardly at an angle of about five and a half degrees to about eight degrees relative to the axis that is perpendicular to the longitudinal axis.

29. The stud bridging/spacing member of claim 27, wherein the notches extend inwardly at an angle of about seven degrees.

30. The stud bridging/spacing member of claim 24, wherein the notches incline in the same direction.

31. The stud bridging/spacing member of claim 24, wherein the notches have a width of about 0.065 inch (about 0.16 cm) to about 0.080 inch (about 0.20 cm).

32. The stud bridging/spacing member of claim 24, wherein the notches have a width of about 0.080 inch (about 0.20 cm).

33. The stud bridging/spacing member of claim 24, wherein the sides of the notches are parallel.

34. The stud bridging/spacing member of claim 24, wherein the elongate member is formed in a thickness selected from the group of fourteen, sixteen or eighteen gauge metal.

35. A metal stud wall comprising:

at least three metal studs each having at least two flanges interconnected by a web, the web of each stud having an opening and the studs being arranged in a row with the openings in the webs thereof aligned with one another; and at least one elongate member as set forth in claim 24 extending through the openings of the at least three studs, the at least three longitudinally spaced apart notches engaging the webs of the studs.

36. The method of claim 34, further comprising securing a top end of each of the studs to a ceiling track.

37. The method of claim 34, wherein engaging includes causing a portion of the webs of the studs to bend in the direction of the inclines of the notches to retain the web in the engaged notch.

* * * * *

UNITED STATES PATENT AND TRADEMARK OFFICE

CERTIFICATE OF CORRECTION

PATENT NO. : 6,708,460 B1
DATED : March 23, 2004
INVENTOR(S) : William L. Elderson It is certified that error appears in the above-identified patent and that said Letters Patent is hereby corrected as shown below:

Title page,
Item [22], PCT Filed, should read -- May 3, 2000" not -- March 5, 2000 --.
Item [60], Related U.S. Application Data, after the first paragraph, as paragraph two, insert the following: -- This application is a 371 Application of PCT/US00/11991, filed May 3, 2000, which claims priority from U.S. Provisional Application Serial No. 60/132,293, filed May 3, 1999 and U.S. Provisional Application Serial No. 60/140,640, filed June 23, 1999. --

Column 1,
Line 5, "Mar. 5, 2000" should read -- May 3, 2000 --.

Column 4,
Line 22, "along 6-6" should read -- along line 6-6 --

Column 12,
Line 37, "24" should read -- 34 --

Signed and Sealed this

Eighth Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,708,460 B1
DATED : March 23, 2004
INVENTOR(S) : William L. Elderson It is certified that error appears in the above-identified patent and that said Letters Patent is hereby corrected as shown below:

Title page,
Item [22], PCT Filed, should read -- May 3, 2000" not "March 5, 2000".
Item [60], Related U.S. Application Data, after the first paragraph, as paragraph two, insert the following: -- This application is a 371 Application of PCT/US00/11991, filed May 3, 2000, which claims priority from U.S. Provisional Application Serial No. 60/132,293, filed May 3, 1999 and U.S. Provisional Application Serial No. 60/140,640, filed June 23, 1999. --

Column 1,
Line 5, "Mar. 5, 2000" should read -- May 3, 2000 --.

Column 4,
Line 22, "along 6-6" should read -- along line 6-6 --

Column 12,
Line 37, "24" should read -- 34 --

Signed and Sealed this

Twenty-second Day of June, 2004

JON W. DUDAS
*Acting Director of the United States Patent and Trademark Office*

UNITED STATES PATENT AND TRADEMARK OFFICE

CERTIFICATE OF CORRECTION

PATENT NO. : 6,708,460 B1
DATED : March 23, 2004
INVENTOR(S) : William L. Elderson It is certified that error appears in the above-identified patent and that said Letters Patent is hereby corrected as shown below:

Column 6,
Lines 3, 43 and 44, delete “rigidity” and replace therewith -- rigidify --.

Column 9,
Line 5, delete “rigidity” and replace therewith -- rigidify --.

Signed and Sealed this

Twenty-seventh Day of July, 2004

JON W. DUDAS
*Acting Director of the United States Patent and Trademark Office*